United States Patent [19]

Rottleb

[11] 4,027,831

[45] June 7, 1977

[54] SPOOL FOR THREAD

[75] Inventor: Dieter Rottleb, Gutach, Germany

[73] Assignee: Gutermann & Co. Aktiengesellschaft, Zurich, Switzerland

[22] Filed: Jan. 19, 1976

[21] Appl. No.: 650,302

[30] Foreign Application Priority Data

Jan. 29, 1975 United Kingdom ..... 3894/75

[52] U.S. Cl. ..... 242/125.1; 242/125.2

[51] Int. Cl.[2] ..... B65H 75/28

[58] Field of Search ..... 242/125.1, 125.2, 125.3, 242/125, 118.4, 118.7, 118.61, 18 PW, 18 EW

[56] References Cited

UNITED STATES PATENTS

| | | | |
|---|---|---|---|
| 3,069,105 | 12/1962 | Press et al. | 242/55.2 |
| 3,658,275 | 4/1972 | Lahmann | 242/125.1 X |
| 3,937,419 | 2/1976 | Bon | 242/118.4 |

*Primary Examiner*—George F. Mautz

*Attorney, Agent, or Firm*—Diller, Brown, Ramik & Wight

[57] ABSTRACT

A unitary moulding of plastics material comprising:

a. a spool member for carrying thread windings, and b. a thread trapping member joined to said spool member by frangible bridging means, said thread trapping member being adapted, after breaking of the frangible bridging means, to be fitted to the end of said spool member so that a surface of the thread trapping member cooperates with a surface of the spool member to form a groove for trapping thread.

14 Claims, 5 Drawing Figures

SPOOL FOR THREAD

This invention relates to a plastic spool for sewing thread provided with means for trapping the thread end.

The traditional spool was made of wood and consisted of a cylindrical body with radial flanges on the two ends. There was provided in one of these flanges a slit into which the thread end could be inserted and so be trapped, thus preventing the thread unwinding from the cylindrical body.

The modern tendency is to use plastics material instead of wood, but there are then difficulties in providing the same thread trapping means. In the first place, it is difficult to mould the plastice spool with a fine slit in the end flange, and there are obvious production drawbacks to cutting such slits as a separate step in the factory after moulding has taken place. Secondly, such slits are in any event undesirable as they tend to chafe the thread.

If it is attempted to avoid these difficulties by forming a smooth-edged slit or groove by the bringing together of two separately moulded parts, this would result in a lack of economy due to the two moulding operations.

According to the present invention there is provided a unitary moulding of plastics material comprising:

a. a spool member for carrying thread windings, and b. a thread trapping member joined to said spool member by frangible bridging means, said thread trapping member being adapted, after breaking of the frangible bridging means, to be fitted to the end of said spool member so that a surface of the thread member co-operates with a surface of the spool member to form a groove for trapping thread.

The said two members are moulded together in a unitary moulding, in which they are joined together by plastic fingers or other frangible bridging means. The frangible bridging means can then be broken to release the thread trapping means. The latter is then fitted to the end of the spool member to form the groove for trapping the end of the thread.

In one preferred form of the invention, an annular flange is provided adjacent an end of the spool member to constitute said surface of the spool member.

In another preferred form of the invention a protuberance is provided extending beyond said flange, said thread trapping member being in the form of a collar adapted to frictionally fit over said protuberance and abut with said flange so as to form said groove.

The preferred embodiments of the invention will now be described by way of illustration of the invention with reference to the accompanying drawings, in which:

FIG. 1 shows a unitary moulding of plastics material.

The main portion of this is a sool member having a cylindrical portion 1 to carry the thread. End flanges 2*a* and 2*b* are provided at the ends of the cylindrical portion 1 for retaining the thread windings. Flange 2*b* is provided with a depending skirt 3. Two rings 2*c* and 2*d* are provided on cylindrical portion 1, and act as winding aids to prevent the thread layers from spreading too much when the winding of the thread on the spool is initially started. A cylindrical protuberance 4 extends axially outwards at the upper end of the spool member and is provided with a plurality of annular ribs 5.

Figure 2:
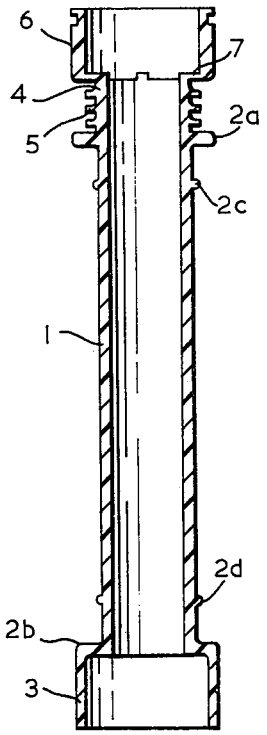
FIG. 2 is a cross-sectional view of FIG. 1 along the line II—II.
Figure 1:
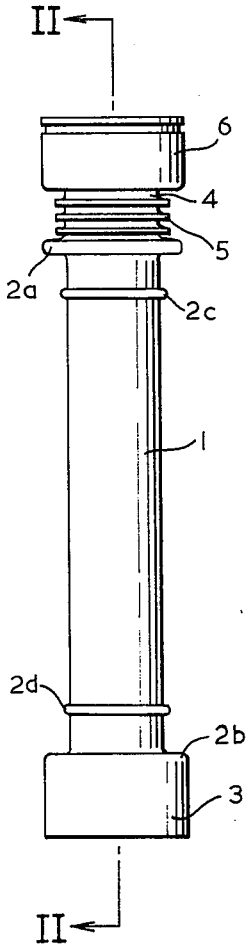
FIG. 1 is a side view of a unitary moulding according to the invention.
Figure 5:
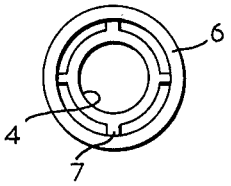
FIG. 5 is an end elevation of the upper end of FIG. 1.
Figure 3:
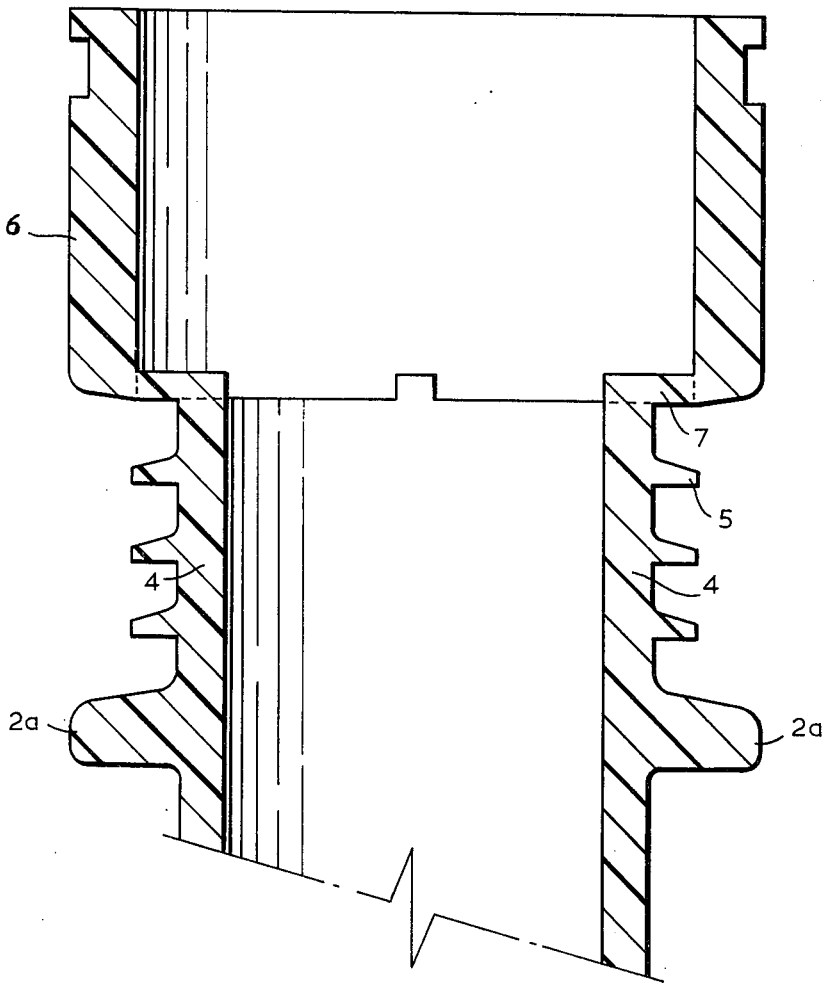
FIG. 3 is an enlarged cross-sectional view of the upper end of FIG. 1 showing the thread trapping means and the spool member attached by fragible bridging means.

The unitary moulding also includes a collar 6 attahced to the protuberance 4 by means of small frangible fingers 7 (not shown in FIG. 1). The annular ribs 5 are of such dimension as to allow the collar to fit frictionally over them.

Figure 4:
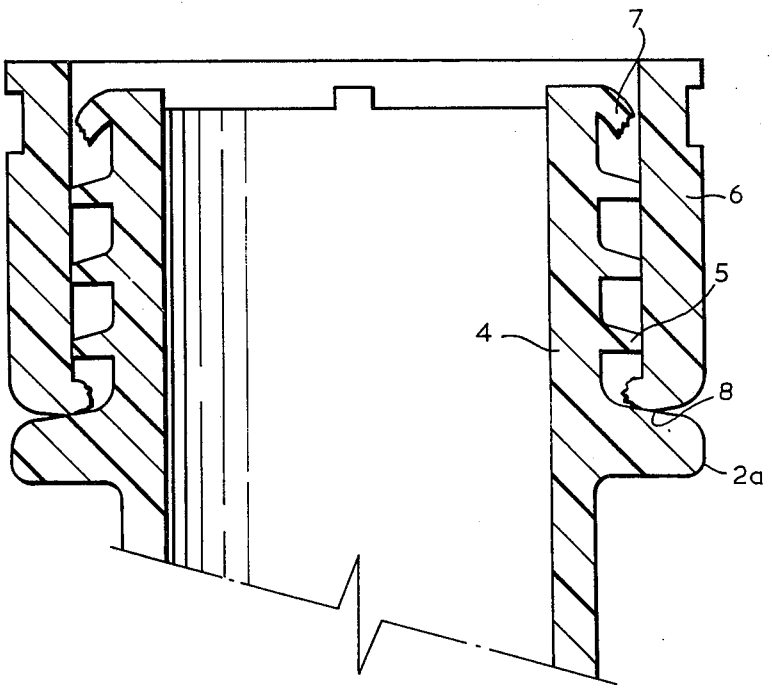
FIG. 4 is an enlarged cross-sectional view showing how a groove can be formed by the two co-operating members.

To form the thread-trapping groove, force is applied to the collar 6 so as to break the fingers 7 and so release collar 6 from the unitary moulding. The collar 6 is then frictionally fitted over the protuberance 4 and annular ribs 5 until the end surface of the collar 6 abuts against the outer surface of the flange 2*a*, as shown in FIG. 4. As will be seen, these two surfaces are so shaped as to form an annular groove 8 between them, in which the thread end can be trapped.

In order to start the winding of thread on a spool in the factory operation of producing sewing thread packages, the inner or beginning end of the thread must be secured to the spool. This can be done by traditional methods, such as by using a small piece of adhesive tape or by cutting a slit in the spool and inserting the thread end therein. However, it is possible with the present invention to insert the inner end of the thread between the collar 6 and flange 2*a*. The collar can then be forced inwardly so as to trap the inner end of the thread. After the winding has been completed, the outer end of the thread can be inserted in the preformed groove.

Alternatively, if the inner end of the thread is secured by traditional means, the outer end of the thread at the completion of winding cam be brought over the top of the flange 2*a*, and the collar 6 can then be forced inwardly so as to trap the thread end. Alternatively, the fingers 7 can be broken and the thread-trapping groove 8 formed prior to the winding of the thread, in which case the final operation of the winding device would be to bring the thread end over the flange 2*a* and into the pre-formed groove 8.

It is possible for both ends of the thread end to be secured in some traditional manner and for the collar 6 to remain in the unitary moulding. The thread user could then effect the breakage of the fingers 7 and utilize the collar 6 for subsequent trapping of the thread end.

When the spool is used for thin or thick threads, the ribs 5 may be suitably constructed, e.g. in the form of rings, to flex so that the collar 6 can move away from the outer surface of the flange 2*a* to facilitate the insertion of the thread into the groove 8.

The principle of the present invention can be applied to the invention described in our British patent specification No. 1,247,970. The inner and outer members described in the latter patent specification for telescoping together can be moulded in one piece, in accordance with the present invention, with frangible bridging means joining them. The inner member described in British specification No. 1,247,790 would be the thread trapping member mentioned herein.

It will be seen therefore that the thread trapping member is not limited to a collar and can take a variety of forms. Likewise the fragible bridging means are not limited to being fingers but can take any other suitable form.

I claim:

1. A unitary moulding of plastics material comprising:

a. a spool member for carrying thread windings, having a male portion at one end thereof, and b. a thread trapping member joined to said spool member by frangible bridging means and having a female portion the internal diameter of which is substantially equal to the external diameter of the male portion of the spool member, said male and female portions being adapted, after breaking of the fringible bridging means, to cooperate together so that a surface of the thread trapping member and a surface of the spool member together form a groove for trapping thread.

2. A unitary moulding according to claim 1, wherein an annular flange is provided adjacent an end of the spoo' member to constitute said surface of the spool member.

3. A unitary moulding according to claim 2 wherein said male portion comprises a protuberance extending beyond said flange away from the other end of the spool, said female portion being in the form of a collar adapted to frictionally fit over said protuberance and abut with said flange so as to form said groove.

4. A unitary moulding according to claim 3 wherein at least one annular rib is provided on the outer surface of said protuberance to frictionally fit within the collar.

5. A unitary moulding according to claim 4, wherein each rib is suitable constructed to flex so that, once the groove has been formed, the collar can move away from said flange for facilitating the insertion of thread into said groove.

6. A unitary moulding according to claim 3 wherein said collar is joined to the end of said protuberance.

7. A unitary moulding according to claim 1 provided with a flange adjacent each end for retaining the thread windings on the spool.

8. A unitary moulding according to claim 1 wherein said frangible bridging means comprises plastic fingers.

9. A spool for thread, said spool being of a one-piece construction and comprising a cylindrical thread receiving portion, end flanges at opposite ends of said cylindrical thread receiving portion, and thread trapping means joined to at least one of said end flanges and forming an axial extension of said cylindrical thread receiving portion; said thread trapping means including a thread end portion receiving part permanently formed with said end flange, a thread end portion trapping member, and a frangible connection between said thread end portion receiving part and said thread end portion trapping member positioning said thread end portion trapping member at an end of said thread end portion receiving part remote from said one end flange, said thread end portion trapping member being tubular and said thread end receiving part having an external size and configuration snugly receivable in said thread end portion trapping member.

10. The spool of claim 9 wherein said frangible connection includes peripherally spaced breakable fingers lying within an axial projection of a major transverse cross-section of said thread end portion receiving part.

11. The spool of claim 10 wherein said thread end portion receiving part is of a reduced outer dimension at said fingers and said fingers are coextensive with said thread end portion receiving part.

12. The spool of claim 10 wherein said fingers lie in a common plane and an end portion of each of said thread end portion receiving part and said thread end portion trapping member lies in said common plane.

13. The spool of claim 9 wherein said thread end portion receiving part has a plurality of outwardly projecting ribs defining therebetween at least one thread receiving groove.

14. A spool of thread comprising:

a. a spool member having a male portion at one end thereof, b. thread wound on said spool member, and c. a thread trapping member joined to said spool member by frangible bridging means, and having a female portion the internal diameter of which is substantialy equal to the external diameter of the male portion of the spool member, said male and female portions being adapted, after breaking of the frangible bridging means, to cooperate together so that a surface of the thread trapping member and a surface of the spool member together form a groove for trapping thread.

* * * * *